US010211522B2

(12) United States Patent
Anderson

(10) Patent No.: US 10,211,522 B2
(45) Date of Patent: Feb. 19, 2019

(54) DENSITY AND POWER CONTROLLED PLASMA ANTENNA

(71) Applicant: SMARTSKY NETWORKS LLC, Charlotte, NC (US)

(72) Inventor: Theodore R. Anderson, Brookfield, MA (US)

(73) Assignee: SMARTSKY NETWORKS LLC, Charlotte, NC (US)

( * ) Notice: Subject to any disclaimer, the term of this patent is extended or adjusted under 35 U.S.C. 154(b) by 575 days.

(21) Appl. No.: 15/219,814

(22) Filed: Jul. 26, 2016

(65) Prior Publication Data

US 2018/0034145 A1 Feb. 1, 2018

(51) Int. Cl.

| | |
|---|---|
| ***H01Q 1/36*** | (2006.01) |
| ***H01Q 5/314*** | (2015.01) |
| ***H01Q 3/44*** | (2006.01) |
| ***H05H 1/00*** | (2006.01) |
| ***H05H 1/46*** | (2006.01) |

(52) U.S. Cl.

CPC ..... *H01Q 1/366* (2013.01); *H01Q 3/44* (2013.01); *H01Q 5/314* (2015.01); *H05H 1/0031* (2013.01); *H05H 1/46* (2013.01); *H05H 2001/463* (2013.01); *H05H 2001/4682* (2013.01)

(58) Field of Classification Search

CPC ..... H01Q 1/366

See application file for complete search history.

(56) References Cited

U.S. PATENT DOCUMENTS

| | | | | |
|---|---|---|---|---|
| 5,963,169 | A * | 10/1999 | Anderson | H01Q 1/26 343/701 |
| 6,304,036 | B1 | 10/2001 | Freeman et al. | |
| 6,700,544 | B2 | 3/2004 | Anderson | |
| 6,870,517 | B1 | 3/2005 | Anderson | |
| 6,922,173 | B2 | 7/2005 | Anderson | |
| 7,292,191 | B2 | 11/2007 | Anderson | |
| 7,342,549 | B2 | 3/2008 | Anderson | |
| 7,453,403 | B2 | 11/2008 | Anderson | |
| 8,077,094 | B2 | 12/2011 | Anderson et al. | |
| RE43,699 | E | 10/2012 | Anderson et al. | |
| 8,384,602 | B2 | 2/2013 | Anderson | |
| 9,444,132 | B2 * | 9/2016 | Stone | H01Q 1/366 |
| 2013/0228550 | A1 | 9/2013 | Mori et al. | |
| 2014/0333485 | A1 * | 11/2014 | Stone | H01Q 1/366 343/701 |
| 2015/0167625 | A1 | 6/2015 | Ikeda | |

FOREIGN PATENT DOCUMENTS

| | | | |
|---|---|---|---|
| WO | 2004114461 | A2 | 12/2004 |

OTHER PUBLICATIONS

International Search Report and Written Opinion of PCT/US2017/043689 dated Oct. 16, 2017.

* cited by examiner

*Primary Examiner* — Thuy Vinh Tran

(74) *Attorney, Agent, or Firm* — Burr Forman McNair

(57) ABSTRACT

A plasma antenna assembly may include a plasma antenna element, a plasma density sensor operably coupled to the plasma antenna element to measure plasma density during ionization of the plasma antenna element, a driver circuit operably coupled to the plasma antenna element to selectively provide pulsed current to the plasma antenna element for ionization of plasma in the plasma antenna element, and a controller operably coupled to the driver circuit and the plasma density sensor to provide control of the plasma density of the plasma antenna element.

20 Claims, 4 Drawing Sheets

DENSITY AND POWER CONTROLLED PLASMA ANTENNA

TECHNICAL FIELD

Example embodiments generally relate to plasma antenna technology and, more particularly, relate to the provision of a plasma antenna that enables smart density and power control.

BACKGROUND

High speed data communications and the devices that enable such communications have become ubiquitous in modern society. These devices make many users capable of maintaining nearly continuous connectivity to the Internet and other communication networks. Although these high speed data connections are available through telephone lines, cable modems or other such devices that have a physical wired connection, wireless connections have revolutionized our ability to stay connected without sacrificing mobility.

Traditionally, antennas have been defined as metallic devices for radiating or receiving radio waves. The paradigm for antenna design has traditionally been focused on antenna geometry, physical dimensions, material selection, electrical coupling configurations, multi-array design, and/or electromagnetic waveform characteristics such as transmission wavelength, transmission efficiency, transmission waveform reflection, etc. As such, technology has advanced to provide many unique antenna designs for applications ranging from general broadcast of RF signals to weapon systems of a highly complex nature. However, plasma antennas provide far more flexibility in terms of their ability to transmit, receive, filter, reflect and/or refract radiation.

The highly reconfigurable nature of plasma antennas, and the ability to turn the antennas on and off quickly, are advantages relative to metal antennas. However, the fact that plasma antennas require significant amounts of energy to be ionized is a disadvantage. Accordingly, research has been performed to try to reduce the power requirements for plasma antennas in order to overcome this disadvantage. Basic "smart" plasma antennas have been built, but the performance would be much greater if plasma density and input power could be known and controlled.

BRIEF SUMMARY OF SOME EXAMPLES

Some example embodiments may therefore be provided in order to enable the provision of a plasma antenna for which power control can effectively be provided while also allowing the plasma density to be controlled. Power requirements for gas ionization can therefore be reduced, while still maintaining effective control over plasma density. Example embodiments may therefore provide for the use of plasma antenna elements in a way that produces a highly flexible and configurable communication structure that can be implemented in a desired manner on the basis of requirements for specific missions or applications. With such a system, aircraft or other communication platforms can take full advantage of the unique attributes of plasma antenna elements while reducing the power requirements.

In one example embodiment, a plasma antenna assembly is provided. The plasma antenna assembly may include a plasma antenna element, a plasma density sensor operably coupled to the plasma antenna element to measure plasma density during ionization of the plasma antenna element, a driver circuit operably coupled to the plasma antenna element to selectively provide pulsed current to the plasma antenna element for ionization of plasma in the plasma antenna element, and a controller operably coupled to the driver circuit and the plasma density sensor to provide control of the plasma density of the plasma antenna element.

In another example embodiment, a method of employing a plasma antenna element is provided. The method may include receiving an indication of a desired plasma density of a plasma antenna element, measuring a current plasma density during ionization of the plasma antenna element with current pulses, comparing the current plasma density to the desired plasma density, and adjusting the current plasma density via a driving circuit that applies the current pulses to the plasma antenna element based on a result of the comparing.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

Figure 4:
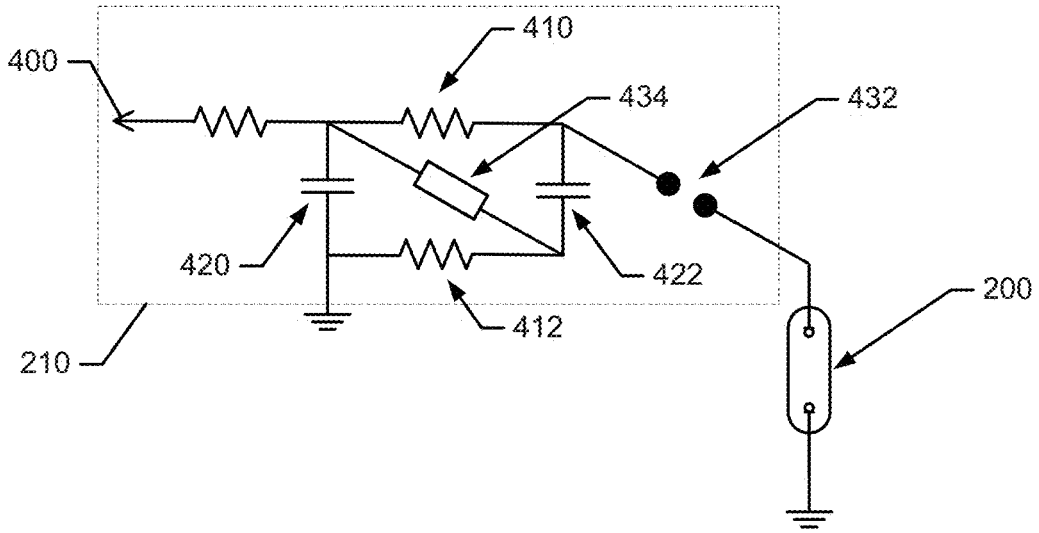
Figure 5:
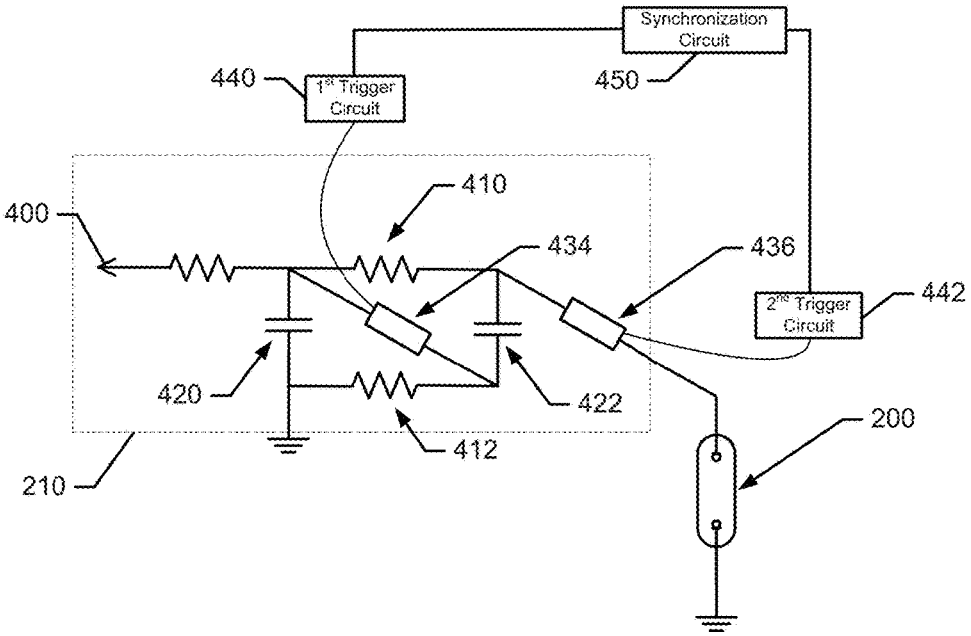

FIG. 4 illustrates an alternative architecture for implementation of the driver circuit that may be utilized to control operation of the plasma antenna elements in accordance with an example embodiment; and FIG. 5 illustrates yet another possible architecture for implementation of the driver circuit that may be utilized to control operation of the plasma antenna elements in accordance with an example embodiment.

DETAILED DESCRIPTION

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements such as reference numerals refer to like elements throughout. Furthermore, as used herein, the term "or" is to be interpreted as a logical operator that results in true whenever one or more of its operands are true. As used herein, the terms "data," "content," "information" and similar terms may be used interchangeably to refer to data capable of being transmitted, received and/or stored in accordance with example embodiments. As used herein, the phrase "operable coupling" and variants thereof should be understood to relate to direct or indirect connection that, in either case, enables functional interconnection of components that are operably coupled to each other. Thus, use of any such terms should not be taken to limit the spirit and scope of example embodiments.

Some example embodiments described herein may provide a device or system in which a component is provided to control operation of a plasma antenna element housed within any suitable enclosure onboard a platform. The plasma antenna element may be operated under the control of the component to function as a radiating antenna, a receiving antenna, a reflector or a lens to manipulate radio frequency (RF) signals associated with wireless communication or other applications. The arrangements of the plasma antenna element or elements of some example embodiments may allow the component to configure the plasma antenna element or elements to support communication over one or multiple frequencies sequentially, simultaneously and/or selectively. Accordingly, plasma antenna advantages including low thermal noise, invisibility to radar when switched off or to a lower frequency than the radar, resistance to electronic warfare, plus the versatility provided by dynamic tuning and reconfigurability for frequency, direction, bandwidth, gain, and beamwidth in both static and dynamic modes of operation, may be provided to the platform hosting the plasma antenna element.

Some example embodiments may employ characteristics of stealth, interference resistance and rapid reconfigurability in order to provide an adaptable and highly capable mobile communication platform. Moreover, example embodiments provide for the intelligently control the plasma density of a plasma antenna element while minimizing input power. Meanwhile, a controller onboard the platform may respond to external stimuli (e.g., user input or environmental conditions) or follow internal programming to make inferences and/or probabilistic determinations about how to steer beams, select array lengths, employ channels/frequencies for communication with various communications equipment. Load balancing, antenna beam steering, interference mitigation, network security and/or denial of service functions may therefore be enhanced by the operation of some embodiments.

Plasma antenna elements of an example embodiment may generally be formed of plasma containers having selected shapes and selected spatial distributions. The plasma containers may have variable plasma density therein, and plasma frequencies may be established in ranges from zero to arbitrary plasma frequencies based on controlling plasma density.

Some of the physics of plasma transparency and reflection are explained as follows. The plasma frequency is proportional to the density of unbound electrons in the plasma or the amount of ionization in the plasma. The plasma frequency sometimes referred to a cutoff frequency is defined as:

$$\omega_p = \sqrt{\frac{4\pi n_e e^2}{me}}$$

where $\eta_e$ is the density of unbound electrons, e is the charge on the electron, and me is the mass of an electron. If the incident RF frequency $\omega$ on the plasma is greater than the plasma frequency $\omega_p$(i.e., when $\omega>\omega_p$), the electromagnetic radiation passes through the plasma and the plasma is transparent. If the opposite is true, and the incident RF frequency $\omega$ on the plasma is less than the plasma frequency $\omega_p$ (i.e., when $\omega<\omega_p$), the plasma acts essentially as a metal, and transmits and receives electromagnetic radiation.

Accordingly, by controlling plasma frequency, it is possible to control the behavior of the plasma antenna element for various applications. The electronically steerable and focusing plasma reflector antenna of the present inventor has the following attributes: the plasma layer can reflect microwaves and a plane surface of plasma can steer and focus a microwave beam on a time scale of milliseconds.

The definition of cutoff as used here is when the displacement current and the electron current cancel when electromagnetic waves impinge on a plasma surface. The electromagnetic waves are cutoff from penetrating the plasma. The basic observation is that a layer of plasma beyond microwave cutoff reflects microwaves with a phase shift that depends on plasma density. Exactly at cutoff, the displacement current and the electron current cancel. Therefore there is an anti-node at the plasma surface, and the electric field reflects in phase. As the plasma density increases from cutoff the reflected field increasingly reflects out of phase. Hence the reflected electromagnetic wave is phase shifted depending on the plasma density. This is similar to the effects of phased array antennas with electronic steering except that the phase shifting and hence steering and focusing comes from varying the density of the plasma from one tube to the next and phase shifters used in phased array technology is not involved.

This allows using a layer of plasma tubes to reflect microwaves. By varying the plasma density in each tube, the phase of the reflected signal from each tube can be altered so the reflected signal can be steered and focused in analogy to what occurs in a phased array antenna. The steering and focusing of the mirror can occur on a time scale of milliseconds. This structure, or others, may be employed in plasma antenna elements of example embodiments. Moreover, regardless of the particular structure employed, example embodiments may enable the plasma antenna element to be operated according to the general principles described above, but require less power to achieve desired plasma densities, and also intelligently select plasma densities in some cases. In an example embodiment, the control of plasma density may be accomplished by controlling the pulse width of the driving current used to ionize the plasma.

Figure 1:
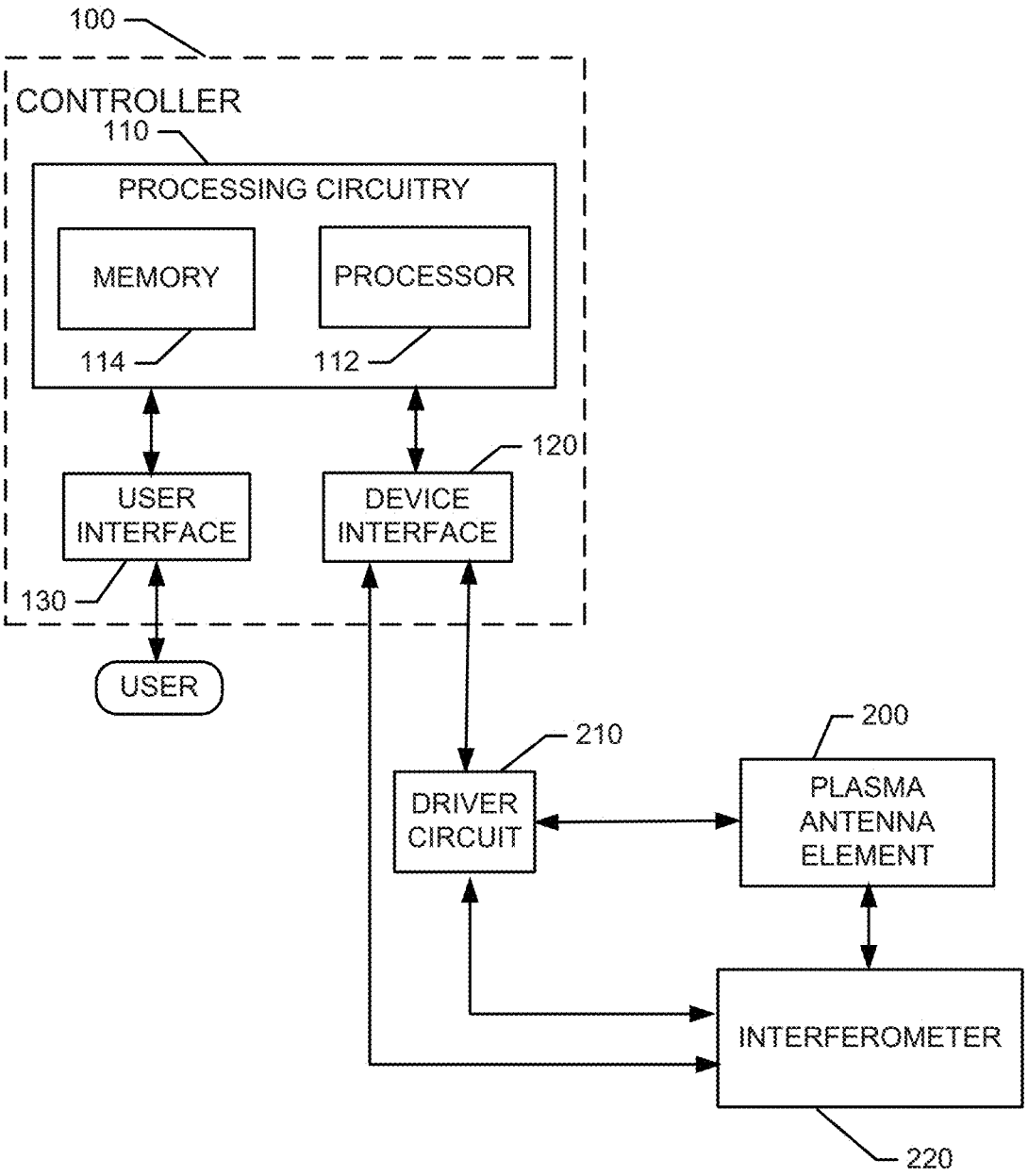
FIG. 1 illustrates a block diagram of a plasma antenna assembly in accordance with an example embodiment.

FIG. 1 illustrates one possible architecture for implementation of a controller 100 that may be utilized to control operation of a plasma antenna element 200 in accordance with an example embodiment. The controller 100 may include processing circuitry 110 configured to provide control outputs for a driver circuit 210 based on processing of various input information, programming information, control algorithms and/or the like. The processing circuitry 110 may be configured to perform data processing, control function execution and/or other processing and management services according to an example embodiment of the present invention. In some embodiments, the processing circuitry 110 may be embodied as a chip or chip set. In other words, the processing circuitry 110 may comprise one or more physical packages (e.g., chips) including materials, components and/or wires on a structural assembly (e.g., a baseboard). The structural assembly may provide physical strength, conservation of size, and/or limitation of electrical interaction for component circuitry included thereon. The processing circuitry 110 may therefore, in some cases, be configured to implement an embodiment of the present invention on a single chip or as a single "system on a chip." As such, in some cases, a chip or chipset may constitute means for performing one or more operations for providing the functionalities described herein.

In an example embodiment, the processing circuitry 110 may include one or more instances of a processor 112 and memory 114 that may be in communication with or otherwise control a device interface 120 and, in some cases, a user interface 130. As such, the processing circuitry 310 may be embodied as a circuit chip (e.g., an integrated circuit chip) configured (e.g., with hardware, software or a combination of hardware and software) to perform operations described herein. However, in some embodiments, the processing circuitry 110 may be embodied as a portion of an on-board computer. In some embodiments, the processing circuitry 110 may communicate with various components, entities, sensors and/or the like, which may include, for example, the driver circuit 210 and/or a plasma density sensor (e.g., an interferometer 220) that is configured to measure plasma density in the plasma antenna element 200 including when the plasma antenna element is operational.

The user interface 130 (if implemented) may be in communication with the processing circuitry 110 to receive an indication of a user input at the user interface 130 and/or to provide an audible, visual, mechanical or other output to the user. As such, the user interface 130 may include, for example, a display, one or more levers, switches, indicator lights, touchscreens, proximity devices, buttons or keys (e.g., function buttons), and/or other input/output mechanisms. The user interface 130 may be used to select channels, frequencies, modes of operation, programs, instruction sets, or other information or instructions associated with operation of the driver circuit 210 and/or the plasma antenna element 200.

The device interface 120 may include one or more interface mechanisms for enabling communication with other devices (e.g., modules, entities, sensors and/or other components). In some cases, the device interface 120 may be any means such as a device or circuitry embodied in either hardware, or a combination of hardware and software that is configured to receive and/or transmit data from/to modules, entities, sensors and/or other components that are in communication with the processing circuitry 110.

The processor 112 may be embodied in a number of different ways. For example, the processor 112 may be embodied as various processing means such as one or more of a microprocessor or other processing element, a coprocessor, a controller or various other computing or processing devices including integrated circuits such as, for example, an ASIC (application specific integrated circuit), an FPGA (field programmable gate array), or the like. In an example embodiment, the processor 112 may be configured to execute instructions stored in the memory 114 or otherwise accessible to the processor 112. As such, whether configured by hardware or by a combination of hardware and software, the processor 112 may represent an entity (e.g., physically embodied in circuitry—in the form of processing circuitry 110) capable of performing operations according to embodiments of the present invention while configured accordingly. Thus, for example, when the processor 112 is embodied as an ASIC, FPGA or the like, the processor 112 may be specifically configured hardware for conducting the operations described herein. Alternatively, as another example, when the processor 112 is embodied as an executor of software instructions, the instructions may specifically configure the processor 112 to perform the operations described herein.

In an example embodiment, the processor 112 (or the processing circuitry 110) may be embodied as, include or otherwise control the operation of the controller 100 based on inputs received by the processing circuitry 110. As such, in some embodiments, the processor 112 (or the processing circuitry 110) may be said to cause each of the operations described in connection with the controller 100 in relation to adjustments to be made to network configuration relative to providing service between access points and mobile communication nodes responsive to execution of instructions or algorithms configuring the processor 112 (or processing circuitry 110) accordingly. In particular, the instructions may include instructions for altering the configuration and/or operation of one or more instances of the plasma antenna element 200 as described herein. The control instructions may mitigate interference, conduct load balancing, implement antenna beam steering, select an operating frequency/channel, select a mode of operation, increase efficiency or otherwise improve performance of the plasma antenna element 200 as described herein.

In an exemplary embodiment, the memory 114 may include one or more non-transitory memory devices such as, for example, volatile and/or non-volatile memory that may be either fixed or removable. The memory 114 may be configured to store information, data, applications, instructions or the like for enabling the processing circuitry 110 to carry out various functions in accordance with exemplary embodiments of the present invention. For example, the memory 114 could be configured to buffer input data for processing by the processor 112. Additionally or alternatively, the memory 114 could be configured to store instructions for execution by the processor 112. As yet another alternative, the memory 114 may include one or more databases that may store a variety of data sets responsive to input sensors and components. Among the contents of the memory 114, applications and/or instructions may be stored for execution by the processor 112 in order to carry out the functionality associated with each respective application/instruction. In some cases, the applications may include instructions for providing inputs to control operation of the controller 100 as described herein.

The interferometer 220 may be any suitable type of interferometer that can be operably coupled to the plasma antenna element 200 to measure the plasma density of plasma in the plasma antenna element 200. The interferometer 220 may make measurements of plasma density at intervals or specific times that are determined or otherwise instructed by the controller 100. The measurements of plasma density may be communicated to the controller 100 and/or to the driver circuit 210.

As shown in FIG. 1, the plasma antenna element 200 is operably coupled to the interferometer 220 and the driver circuit 210. The driver circuit 210 and the interferometer 220 may also be operably coupled to the controller 100. Thus, the plasma antenna element 200 may be operated based on a feedback loop of instructions and information where the feedback loop includes the driver circuit 210 (operating under the control of the controller 100), the plasma antenna element 200 and the interferometer 220. In particular, for example, the controller 100 may provide instructions to the driver circuit 210 regarding ionization of the plasma in the plasma antenna element 200 to achieve certain functional characteristics in the performance of the plasma antenna element 200. The driver circuit 210 may then operate to control plasma density in the plasma antenna element 200 based on the instructions from the controller 100. The interferometer 220 may then measure (continuously or at intervals or times determined by the controller 100) plasma density and provide information indicative of plasma density to the driver circuit 210 and/or the controller 100.

Accordingly, for example, the controller 100 may define a target plasma density for the plasma antenna element 200 and the driver circuit 210 may be operated to provide fast high current pulses to the plasma antenna element 200 to ionize the gas therein. The interferometer 220 may measure the current plasma density and report the measurement to the controller 100 (or driver circuit 210). If the current plasma density is below the target plasma density, then the driver circuit 210 may continue to operate to increase the plasma density in the plasma antenna element 200. This may include increasing average power supplied to the plasma antenna element 200 or maintaining the current average power supplied if the trend measured shows an increase toward the target plasma density. If the current plasma density is above the target plasma density, then the driver circuit 210 may reduce average power delivered to the plasma antenna element 200 to enable the plasma density of the plasma antenna element 200 to reduce toward the target plasma density. The feedback loop may continue to operate to maintain the current plasma density at or near the target plasma density. The components of FIG. 1, which form and support the feedback loop, may be provided in a plasma antenna assembly or system that can be mounted on a platform (e.g., a mobile or fixed platform) configured to support wireless communications.

Figure 2:
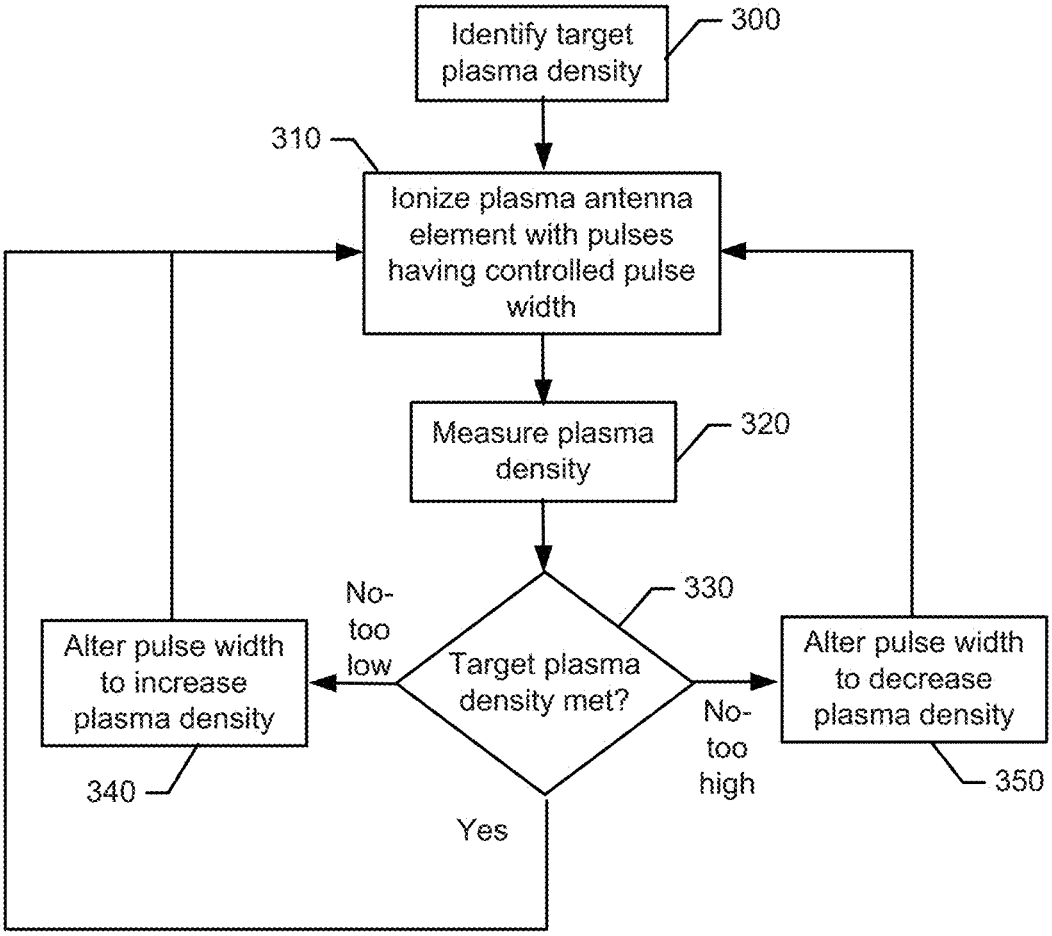
FIG. 2 illustrates a block diagram of a method for operation of plasma antenna elements of an example embodiment.

Any change in target plasma density triggered by user input or by programmed operation of the controller 100 may then cause a corresponding change in operation of the driver circuit 210 to achieve the new target plasma density. FIG. 2 illustrates a block diagram of control flow for operation of the plasma antenna element 200 in accordance with an example embodiment. As shown in FIG. 2, identification of a target plasma density may initially be provided at operation 300. The identification of target plasma density may be made based on factors or inputs described above. Thereafter, ionization of plasma in the plasma antenna element may be performed by providing fast, high current pulses (e.g., from the driver circuit 210) having controlled pulse width at operation 310. Plasma density may then be measured (e.g., by the interferometer 220) at operation 320. A decision may then be made at operation 330 as to whether the measured (i.e., current) plasma density is equal to the target plasma density. If measured plasma density equals target plasma density, then ionization may continue with the current pulse width. However, if measured plasma density is lower than target plasma density, then pulse width may be altered to increase the plasma density at operation 340. Meanwhile, if measured plasma density is higher than target plasma density, then pulse width may be altered to decrease the plasma density at operation 350. In any case, the measured plasma density is used as feedback to allow continuous monitoring and adjustment (if needed) to achieve the desired plasma density by controlling pulse width.

Example embodiments may operate over a range of frequencies that may be required for various different applications. However, it should be noted specifically that example embodiments can also work well at frequencies above 800 MHz due to the ability of the driver circuit 210 to generate fast, high current pulses. Current provided by a DC source may be used to power plasma antennas. However, providing DC current uses more power, when it is known that plasma can be initiated very quickly (e.g., in less than a microsecond) after ionization current is applied. Furthermore, when ionizing current is turned off, the ions in the plasma take about a millisecond to recombine with electrons. Accordingly, plasma density stays high for about a millisecond even after ionizing current is no longer applied.

Given the speed with which ionization occurs after ionizing current is applied, and the fact that there is a slight delay after ionization current is turned off before plasma density becomes low, it should be appreciated that the use of pulsed input power instead of DC power can reduce overall power consumption by an amount that is dependent upon the duty cycle of applying the ionizing current. Example embodiments not only employ pulsed current, but allow the pulse width to be controlled, as described above, in order to use less power. However, ionizing current is still generally required to be fairly high, so a large DC voltage source is normally required to generate relatively high DC current pulses. Example embodiments may further reduce the requirements for providing an effective plasma antenna element by employing a suitable pulsed voltage doubler circuit, which will allow a lower voltage DC power supply to be used for input power to the pulsing circuit that is included in or otherwise embodies the driver circuit 210.

Figure 3:
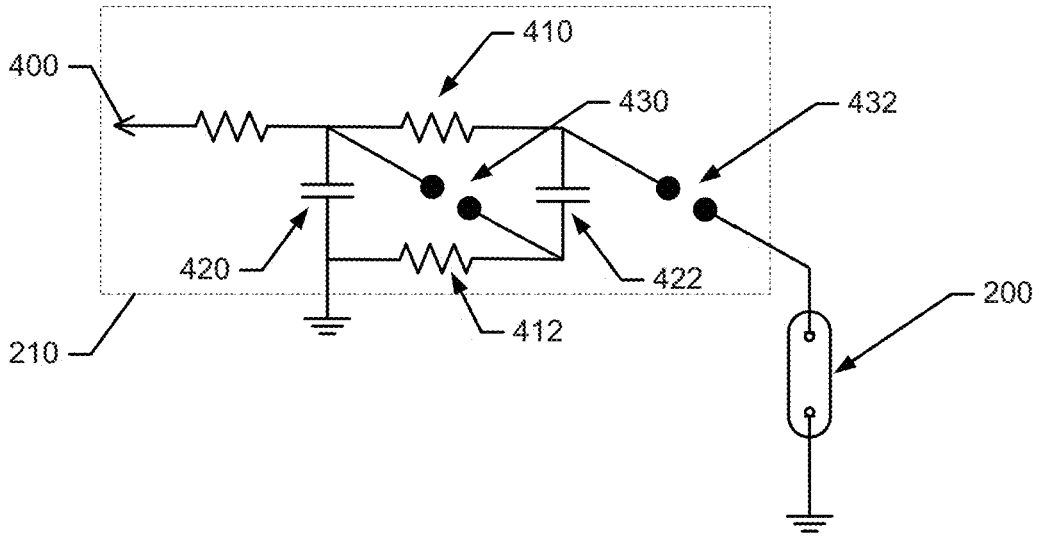
FIG. 3 illustrates one possible architecture for implementation of a driver circuit that may be utilized to control operation of the plasma antenna elements in accordance with an example embodiment.

FIGS. 3-5 illustrate various specific examples of structures that could be employed to function as the driver circuit 210. In this regard, FIG. 3 illustrates a structure in which a DC source 400 is used to power a voltage doubler circuit. The voltage doubler circuit in FIG. 3 includes a first resistor 410 and a second resistor 412 that are operably coupled to each other via a first capacitor 420 and a second capacitor 422 at respective opposing ends thereof. The configuration of the first and second resistors 410 and 412, and the first and second capacitors 420 and 422 is similar to that of a Marx generator in that the first and second capacitors 420 and 422 are charged in parallel from the DC source 400, but are enabled to discharge in series through a first spark gap 430 and a second spark gap 432 when breakover voltage is reached for the first and second spark gaps 430 and 432. When the breakover voltage is reached, the first and second spark gaps 430 and 432 act as short circuits to enable both the first and second capacitors 420 and 422 to discharge through the plasma antenna element 200 thereby providing the plasma antenna element 200 with a pulse of DC current as the ionizing current.

The parallel charge, and series discharge, of the first and second capacitors 420 and 422 effectively doubles the voltage of the DC source 400. In particular, for example, if the DC source 400 is a 1000 $V_{DC}$ power supply, then the discharge of the first and second capacitors 420 and 422 through the plasma antenna element 200 could effectively double (or nearly so) the voltage provided to the plasma antenna element 200 to about 2000 $V_{DC}$. Although not required, in one example embodiment, the first and second resistors 410 and 412 (along with a resistor provided between the DC source 400 and the voltage doubler circuit) may each be 5 KΩ resistors. The first and second capacitors 420 and 422 may each be 0.022 MF capacitors. The pulse generation characteristics that result from the example of FIG. 3 generally include 5 μsec pulses in width.

In some example embodiments, in order to have further control of the timing of pulse generation (and therefore also the pulse width), at least one of the first and second spark gaps 430 and 432 could be replaced with an electronic switch 434. FIG. 4 illustrates an example in which the first spark gap 430 is replaced with a first electronic switch 434. However, it should be appreciated that the second spark gap 432 could alternatively be replaced. Moreover, as shown in FIG. 5, both the first and second spark gaps 430 and 432 could be replaced with respective first and second electronic switches 434 and 436.

In some example embodiments, the first and second electronic switches 434 and 436 may be instances of insulated-gate bipolar transistors (IGBT) that is a high efficiency electronic switch that is further capable of very fast switching. By employing the first electronic switch 434 and one spark gap (e.g., the second spark gap 432 of FIG. 4), the pulse from the driver circuit 210 may be reduced from the 5 μsec pulse width mentioned above to about 1 μsec. By reducing the pulse width by a factor of five, the power consumption can also be reduced by a factor of five by using the structure of FIG. 4 instead of the structure of FIG. 3. Furthermore, repetition times can be improved by using two electronic switches (as shown in FIG. 5). The example embodiment of FIG. 5, which uses the first and second electronic switches 434 and 436 along with a CMOS timer IC for synchronization, can enable the driver circuit 210 to generate 1 μsec pulses with a repetition time of about 750 μsec.

In an example embodiment, the triggering of the first and second electronic switches 434 and 436 may require one or more circuits that are synchronized. FIG. 5 illustrates a first trigger circuit 440 that is configured to trigger the first electronic switch 434, and a second trigger circuit 442 that is configured to trigger the second electronic switch 436. Meanwhile, a synchronization circuit 450 (e.g., the CMOS timer IC) is provided to synchronize the operation of the first and second trigger circuits 440 and 442 to within 100 nsec of accuracy. By enabling accurate synchronization of the first and second trigger circuits 440 and 442, the first and second electronic switches 434 and 436 can apply double the voltage of the DC source 400 to the plasma antenna element 200 with a fine amount of control. The duty cycle of pulsed ionization current can be reduced, but also controlled to generate the desired amount of plasma density for a given application or situation. Thus, a smart plasma antenna element is effectively created, which can use a feedback loop for controlling plasma density while minimizing power consumption.

As can be appreciated from the descriptions above, one or more of the plasma antenna elements 200 may be configured to support wireless communication between external communication equipment and a platform employing the one or more plasma antenna elements 200. The provision of the plasma antenna elements 200 for communications support may provide for configurable communications capabilities while minimizing the penetrations through the fuselage of an aircraft and may also minimize the drag associated with providing communications antennas for the aircraft. However, numerous other platforms may also benefit from employing example embodiments of the plasma antenna element 200, and the plasma antenna assembly of FIG. 1.

In some embodiments, the plasma antenna element 200 within any given enclosure may include one or a plurality of plasma discharge tubes. In cases where multiple plasma discharge tubes are provided, the plasma discharge tubes may be arranged in any desirable orientation or configuration. In some cases, at least some of the plasma discharge tubes may be arranged in an end to end fashion so that they lie substantially inline with each other and are electrically coupled. In such an example, individual ones of the plasma discharge tubes may be selectively turned on (i.e., ionized) or off to generate an array of any desired length further under the control of the controller 100. However, plasma frequency is related to plasma density, and thus, the controller 100 can also or alternatively be configured to control the frequency of any array employing plasma antenna elements simply by controlling the plasma density as described herein. In any case, the controller 100 may also be configured to control the plasma antenna elements to perform time and/or frequency multiplexing so that many RF subsystems (e.g., multiple different radios associated with the radio circuitry) may share the same antenna resources. In situations where the frequencies are relatively widely separated, the same aperture may be used to transmit and receive signals in an efficient manner. In some embodiments, higher frequency plasma antenna arrays may be arranged to transmit and receive through lower frequency plasma antenna arrays. Thus, for example, the arrays may be nested in some embodiments such that higher frequency plasma antenna arrays are placed inside lower frequency plasma antenna arrays.

In some embodiments, multiple reconfigurable or preconfigured antenna elements may be provided to enable communications over a wide range of frequencies covering nearly the entire spectrum, or at least being capable of providing such coverage based on relatively minimal changes to controllable and selectable characteristics of the plasma antenna array and the components associated therewith by the controller 100. Some ranges or specific frequencies may be emphasized for certain commercial reasons (e.g., 790 MHz to 6 GHz, 2.4 GHz, 5.8 GHz, 14 GHz, 26 GHz, 58 GHz, etc.). However, in all cases, the controller 100 may be configured to provide at least some control over the frequencies, channels, multiplexing strategies, beam forming, or other technically enabling programs that are employed. Because plasma antennas can be 'tuned' in nanoseconds, fast switching could also accomplish the same goal of using the same physical plasma antenna element to communicate at high speed with multiple devices in a Time-division duplexed fashion. This capability may enhance the functional features of a cognitive radio design by providing for high-speed scanning of a wide range of frequencies, then quickly converting to a targeted frequency once identified.

As mentioned above, beam forming capabilities may be enhanced or provided by the controller 100 exercising control over the plasma antenna element 200. In this regard, for example, the plasma antenna element 200 or portions thereof may be operated to generate reflective properties or employ beam collimation so that beam steering may be accomplished. In such an example, the controller 100 may be configured to control the plasma antenna element 200 to focus or steer plasma antenna element 200 radiation patterns to allow shaping and steering of beams using a single instance of the plasma antenna element 200 without the use of a phased array. As an alternative, given the availability of space for providing multiple arrays employing the plasma antenna elements 200, the controller 100 could be used to coordinate operation of multiple plasma antenna elements 200 to act in a manner similar to a phased array by using coordination of the multiple plasma antenna elements 200 to conduct beam steering.

Regardless of whether the plasma antenna elements 200 are used to radiate, receive, focus beams, steer beams, reflect beams or otherwise conduct some form of beamforming function, the controller 100 may be used to control the operation of the plasma antenna elements 200 to achieve the desired functionality, but further enable the plasma antenna elements to be operated efficiently and intelligently. In this regard, some example embodiments may employ the memory 114 to store information indicative of plasma density relationships to plasma frequency or other operational characteristics. Thus, the controller 100 may be enabled to access desired operational characteristics from the memory 114, and control the plasma antenna elements 200 to achieve the plasma density characteristics (through the feedback loop described herein) that correspond to the desired operational characteristics. The memory 114 may also buffer dynamic information indicative of current plasma density to control the feedback loop to achieve the desired plasma density for any given operational scenario. In this regard, the processing circuitry 110 may be configured to process the information stored or buffered in the memory 114, or received in real time from the interferometer 220, to determine necessary pulse width adjustments for the driver circuit 210 to achieve desired operational characteristics.

Moreover, it should be appreciated that example embodiments may enable the storage and analysis of relationships known or established between specified plasma densities and corresponding input power levels and pulse widths employed to achieve the specified densities for each of a plurality of different gas species. Thus, for example, when developing a communication platform with known weight, power, space and/or other restrictions, a selected input power and pulse width to achieve the plasma densities needed for a given application may be determined, and then the best gas species to employ in the plasma antenna element given the applicable restrictions may further be determined.

In some example embodiments, the system of FIG. 1 may provide an environment in which the controller 100 of FIG. 1 may provide a mechanism via which a number of useful methods may be practiced. FIG. 2 illustrates a block diagram of one method that may be associated with the system of FIG. 1 and the controller 100 of FIG. 1. From a technical perspective, the controller 100 described above may be used to support some or all of the operations described in FIG. 2. As such, the platform described in FIG. 1 may be used to facilitate the implementation of several computer program and/or network communication based interactions. As an example, FIG. 2 is a flowchart of a method and program product according to an example embodiment of the invention. It will be understood that each block of the flowchart, and combinations of blocks in the flowchart, may be implemented by various means, such as hardware, firmware, processor, circuitry and/or other device associated with execution of software including one or more computer program instructions. For example, one or more of the procedures described above may be embodied by computer program instructions. In this regard, the computer program instructions which embody the procedures described above may be stored by a memory device (e.g., of the controller 100) and executed by a processor in the device. As will be appreciated, any such computer program instructions may be loaded onto a computer or other programmable apparatus (e.g., hardware) to produce a machine, such that the instructions which execute on the computer or other programmable apparatus create means for implementing the functions specified in the flowchart block(s). These computer program instructions may also be stored in a computer-readable memory that may direct a computer or other programmable apparatus to function in a particular manner, such that the instructions stored in the computer-readable memory produce an article of manufacture which implements the functions specified in the flowchart block(s). The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, a method according to one embodiment of the invention, as shown generally in FIG. 2, may include various operations that generally accomplish, for example, receiving an indication of a desired plasma density of a plasma antenna element, measuring a current plasma density during ionization of the plasma antenna element with current pulses, comparing the current plasma density to the desired plasma density, and adjusting the current plasma density via a driving circuit that applies the current pulses to the plasma antenna element based on a result of the comparing.

In some embodiments, the operations described above, summarizing the more detailed method of FIG. 2 may include additional, optional operations, and/or the operations described above may be modified or augmented. Some examples of modifications, optional operations and augmentations are described below. It should be appreciated that the modifications, optional operations and augmentations may each be added alone, or they may be added cumulatively in any desirable combination. In an example embodiment, adjusting the current plasma density may include altering a pulse width of the current pulses to increase plasma density responsive to current plasma density being less than desired plasma density. Additionally or alternatively, adjusting the current plasma density may include altering a pulse width of the current pulses to decrease plasma density responsive to current plasma density being greater than desired plasma density. Additionally or alternatively, adjusting the current plasma density may include controlling a pulse width of the current pulses via a pulsing circuit that comprises a voltage doubler. Additionally or alternatively, controlling the pulse width may include employing a synchronization circuit to control triggering of a first electronic switch and a second electronic switch of the voltage doubler in synchronization. Additionally or alternatively, controlling the pulse width may include employing two capacitors that charge in parallel and discharge in series to discharge in synchronization responsive to operation of the synchronization circuit.

In some embodiments, the controller that performs the method above (or a similar controller) may be a portion of a plasma antenna assembly or system. The system or assembly may include a plasma antenna element, a plasma density sensor operably coupled to the plasma antenna element to measure plasma density during ionization of the plasma antenna element, a driver circuit operably coupled to the plasma antenna element to selectively provide pulsed current to the plasma antenna element for ionization of plasma in the plasma antenna element, and a controller operably coupled to the driver circuit and the plasma density sensor to provide control of the plasma density of the plasma antenna element.

In some embodiments, the assembly described above may include additional and/or optional components and/or the components described above may be modified or augmented. Some examples of modifications, optional changes and augmentations are described below. It should be appreciated that the modifications, optional changes and augmentations may each be added alone, or they may be added cumulatively in any desirable combination. In an example embodiment, the controller may be configured to control a pulse width of the pulsed current based on plasma density measured by the plasma density sensor. In an example embodiment, the controller may be configured to direct an increase to the pulse width responsive to the plasma density measured being less than a target plasma density or direct a decrease to the pulse width responsive to the plasma density measured being greater than a target plasma density. In an example embodiment, the driver circuit may include a voltage doubler circuit configured to double a source voltage provided by the driver circuit to the plasma antenna element for ionization. In some cases, the voltage doubler circuit may be configured to charge a first capacitor and a second capacitor in parallel from the source voltage and discharge the first and second capacitors in series across a first spark gap and a second spark gap to provide ionization current pulses to the plasma antenna element. Alternatively, the voltage doubler circuit may be configured to charge a first capacitor and a second capacitor in parallel from the source voltage and discharge the first and second capacitors in series across a first spark gap and a first electronic switch to provide ionization current pulses to the plasma antenna element. As yet another alternative, the voltage doubler circuit may be configured to charge a first capacitor and a second capacitor in parallel from the source voltage and discharge the first and second capacitors in series across a first electronic switch and a second electronic switch to provide ionization current pulses to the plasma antenna element. In such an example, the first and second electronic switches may each be triggered by a respective one of a first trigger circuit and a second trigger circuit where the first and second trigger circuits are controlled by a synchronization circuit. In some cases, the synchronization circuit may be a CMOS timer integrated circuit configured to enable shortening of a pulse width of the current pulses. In an example embodiment, the first and second electronic switches may be embodied as insulated-gate bipolar transistors (IGBTs). In some examples, the plasma density sensor may be embodied as an interferometer. In such an example, the controller may be configured to receive the measured plasma density from the interferometer and compare the measured plasma density to a desired plasma density to adjust a pulse width of the current pulses based on a difference between the measured plasma density and the desired plasma density. In some cases, the desired plasma density is input via the controller.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

What is claimed is:

1. A plasma antenna assembly comprising:

a plasma antenna element;

a plasma density sensor operably coupled to the plasma antenna element to measure plasma density during ionization of the plasma antenna element;

a driver circuit operably coupled to the plasma antenna element to selectively provide pulsed current to the plasma antenna element for ionization of plasma in the plasma antenna element; and a controller operably coupled to the driver circuit and the plasma density sensor to provide control of the plasma density of the plasma antenna element.

2. The plasma antenna assembly of claim 1, wherein the controller is configured to control a pulse width of the pulsed current based on plasma density measured by the plasma density sensor.

3. The plasma antenna assembly of claim 2, wherein the controller is configured to direct an increase to the pulse width responsive to the plasma density measured being less than a target plasma density.

4. The plasma antenna assembly of claim 2, wherein the controller is configured to direct a decrease to the pulse width responsive to the plasma density measured being greater than a target plasma density.

5. The plasma antenna assembly of claim 1, wherein the driver circuit comprises a voltage doubler circuit configured to double a source voltage provided by the driver circuit to the plasma antenna element for ionization.

6. The plasma antenna assembly of claim 5, wherein the voltage doubler circuit is configured to charge a first capacitor and a second capacitor in parallel from the source voltage and discharge the first and second capacitors in series across a first spark gap and a second spark gap to provide ionization current pulses to the plasma antenna element.

7. The plasma antenna assembly of claim 5, wherein the voltage doubler circuit is configured to charge a first capacitor and a second capacitor in parallel from the source voltage and discharge the first and second capacitors in series across a first spark gap and a first electronic switch to provide ionization current pulses to the plasma antenna element.

8. The plasma antenna assembly of claim 5, wherein the voltage doubler circuit is configured to charge a first capacitor and a second capacitor in parallel from the source voltage and discharge the first and second capacitors in series across a first electronic switch and a second electronic switch to provide ionization current pulses to the plasma antenna element.

9. The plasma antenna assembly of claim 8, wherein the first and second electronic switches are each triggered by a respective one of a first trigger circuit and a second trigger circuit, the first and second trigger circuits being controlled by a synchronization circuit.

10. The plasma antenna assembly of claim 9, wherein the synchronization circuit comprises a CMOS timer integrated circuit configured to enable shortening of a pulse width of the current pulses.

11. The plasma antenna assembly of claim 8, wherein the first and second electronic switches comprise insulated-gate bipolar transistors (IGBTs).

12. The plasma antenna assembly of claim 1, wherein the plasma density sensor comprises an interferometer.

13. The plasma antenna assembly of claim 12, wherein the controller is configured to receive the measured plasma density from the interferometer and compare the measured plasma density to a desired plasma density to adjust a pulse width of the current pulses based on a difference between the measured plasma density and the desired plasma density.

14. The plasma antenna assembly of claim 13, wherein the desired plasma density is input via the controller.

15. A method comprising:

receiving an indication of a desired plasma density of a plasma antenna element;

measuring a current plasma density during ionization of the plasma antenna element with current pulses;

comparing the current plasma density to the desired plasma density; and adjusting the current plasma density via a driving circuit that applies the current pulses to the plasma antenna element based on a result of the comparing.

16. The method of claim 15, wherein adjusting the current plasma density comprises altering a pulse width of the current pulses to increase plasma density responsive to current plasma density being less than desired plasma density.

17. The method of claim 15, wherein adjusting the current plasma density comprises altering a pulse width of the current pulses to decrease plasma density responsive to current plasma density being greater than desired plasma density.

18. The method of claim 15, wherein adjusting the current plasma density comprises controlling a pulse width of the current pulses via a pulsing circuit that comprises a voltage doubler.

19. The method of claim 18, wherein controlling the pulse width comprises employing a synchronization circuit to control triggering of a first electronic switch and a second electronic switch of the voltage doubler in synchronization.

20. The method of claim 19, wherein controlling the pulse width comprises employing two capacitors that charge in parallel and discharge in series to discharge in synchronization responsive to operation of the synchronization circuit.

* * * * *